US006011362A

United States Patent [19]

Moisin

[11] Patent Number: 6,011,362

[45] Date of Patent: Jan. 4, 2000

[54] MAGNETIC BALLAST ADAPTOR CIRCUIT

[75] Inventor: Mihail S. Moisin, Brookline, Mass.

[73] Assignee: Electro-Mag International, Inc.

[21] Appl. No.: 08/753,044

[22] Filed: Nov. 19, 1996

[51] Int. Cl.[7] ..... G05F 1/00

[52] U.S. Cl. ..... 315/307; 315/291; 315/225; 315/58; 315/DIG. 2

[58] Field of Search ..... 315/209 R, 224, 315/225, 291, 307, 205, DIG. 2, DIG. 5, DIG. 7, 56, 58

[56] References Cited

U.S. PATENT DOCUMENTS

| | | | |
|---|---|---|---|
| 4,682,083 | 7/1987 | Alley | 315/307 |
| 4,777,409 | 10/1988 | Tracy et al. | 315/200 R |
| 4,818,917 | 4/1989 | Vest | 315/171 |
| 5,027,032 | 6/1991 | Nilssen | 315/103 |
| 5,216,332 | 6/1993 | Nilssen | 315/224 |
| 5,223,767 | 6/1993 | Kulka | 315/209 R |
| 5,256,939 | 10/1993 | Nilssen | 315/244 |
| 5,309,066 | 5/1994 | Ditlevsen | 315/205 |
| 5,493,180 | 2/1996 | Bezdon et al. | 315/91 |
| 5,504,398 | 4/1996 | Rothenbuhler | 315/209 R |
| 5,608,295 | 3/1997 | Moisin | 315/247 |
| 5,636,111 | 6/1997 | Griffin et al. | 363/37 |
| 5,694,007 | 12/1997 | Chen | 315/247 |

FOREIGN PATENT DOCUMENTS

| | | |
|---|---|---|
| 0460641 | 12/1991 | European Pat. Off. . |
| 0522266 | 1/1993 | European Pat. Off. . |
| 4010435 | 10/1991 | Germany . |
| 9535646 | 12/1995 | WIPO . |

OTHER PUBLICATIONS

"Simple Dimming Circuit for Fluorescent Lamp", IBM Technical Disclosure Bulletin, vol. 34, No. 4A, Sep. 1, 1991, pp. 109–111, XP000210848.

*Primary Examiner*—Haissa Philogene
*Attorney, Agent, or Firm*—Nutter, McClennen & Fish, LLP

[57] ABSTRACT

A method and apparatus for efficiently driving a load coupled to a ballast is described. A switching element coupled between a pair of ballast terminals converts a low frequency drive signal to a high frequency drive signal which is provided to the load.

23 Claims, 10 Drawing Sheets

MAGNETIC BALLAST ADAPTOR CIRCUIT

GOVERNMENT RIGHTS

Not applicable.

RELATED APPLICATIONS

Not applicable.

FIELD OF THE INVENTION

This invention relates generally to lighting systems and more particularly to methods and apparatus for starting and operating light sources.

BACKGROUND OF THE INVENTION

As is known in the art, a light source or lamp generally refers to an electrically powered man made element which produces light having a predetermined color such as a white or a near white. Light sources may be provided, for example, as incandescent light sources, fluorescent light sources and high-intensity discharge (HID) light sources such as mercury vapor, metal halide, high-pressure sodium and low-pressure sodium light sources.

As is also known, fluorescent and HID light sources are driven by a ballast. A ballast is a device which by means of inductance, capacitance or resistance, singly or in combination, limits a current provided to a light source such as a fluorescent or a high intensity discharge light source, for example. The ballast provides an amount of current required for proper lamp operation. Also, in some applications, the ballast may provide a required starting voltage and current. In the case of so-called rapid start lamps, the ballast heats a cathode of the lamp prior to providing a strike voltage to the lamp.

As is also known, a relatively common ballast is a so-called magnetic or inductive ballast. A magnetic ballast refers to any ballast which includes a magnetic element such as a laminated, iron core or an inductor. Magnetic ballasts are typically reliable and relatively inexpensive and drive lamps coupled thereto with a signal having a relatively low frequency. One problem with magnetic ballasts, however, is that the relatively low frequency drive signal which they provide results in a relatively inefficient lighting system. Furthermore, magnetic ballasts tend to incur substantial heat losses which further lowers the efficiency of lighting systems utilizing a low frequency magnetic ballast.

In addition to efficiency, it is desirable, in some applications, to provide an instant-start lamp capability. Instant-start capability refers to the capability of starting a lamp within 50 milli-seconds (msec) of the time a strike voltage is provided to the lamp. To accomplish this, the ballast must provide a strike voltage typically in the range of about 500 V RMS. Magnetic ballasts are unable to produce a strike voltage which is large enough to cause the lamp to operate in an instant-start mode.

In an attempt to overcome the low efficiency problem caused by the low frequency operating characteristic of magnetic ballasts as well as the inability to operate in an instant-start mode, attempts have been made to replace magnetic ballasts with electronic ballasts. Electronic ballasts drive the lamps with relatively high frequency drive signals and can provide strike voltages which allow instant-start lamp operation. One problem with electronic ballasts, however, is that they, however, utilize a relatively large number of circuit components which reduces reliability and maintainability of the electronic ballast while increasing cost of the ballast.

Furthermore, in a lighting unit which includes a light source, a reflector, a housing and a magnetic ballast, it is relatively expensive to replace the magnetic ballast with an electronic ballast. This is due, at least in part, to the costs associated with the electronic ballast itself as well as the cost of labor required to physically disconnect the magnetic ballast from the lamp and electrically connect the electronic ballast to the lamp. Furthermore, some ballasts include a potting material which may include hazardous materials such as PCBs and asbestos. It is necessary to dispose of such hazardous waste materials in a particular manner and such disposal costs are significant.

It would therefore, be desirable to provide a relatively inexpensive circuit which allows a magnetic ballast to provide high frequency operation of a light source and which is relatively easy and inexpensive to couple to existing light units which utilize magnetic ballasts.

SUMMARY OF THE INVENTION

In accordance with the present invention, a ballast adaptor circuit for providing an excitation signal from a ballast source to a load includes a rectifier circuit having a first pair of terminals coupled to the ballast source and a second pair of terminals, a control circuit having a first and second terminal coupled to corresponding ones of the second pair of rectifier circuit terminals and an output terminal and a switching element having a pair of terminals coupled to the second pair of terminals of the rectifier circuit and a control terminal coupled to the output terminal of the control circuit. With this particular arrangement, an adaptor circuit which converts a magnetic ballast signal having a relatively low frequency characteristic to a lamp drive signal having a relatively high frequency characteristic is provided. In one particular embodiment, the load is provided as a fluorescent lamp or a high energy discharge lamp and the control circuit is provided as a pulse width modulator circuit which controls the duty cycle of the switching element. The switching element is operated at a duty cycle which chops the supply current through the fluorescent lamp resulting in high frequency operation of the fluorescent lamp. High frequency operation of the lamp results in improved lighting efficiency and extends the operating life of the lamp. The rectifier circuit may be provided as a full wave bridge rectifier and the switch may be provided as a field effect transistor and in particular as a metal oxide semiconductor field effect transistor (MOSFET). The adaptor circuit may also include a bias circuit coupled between the rectifier circuit and the pulse width modulator circuit. The bias circuit couples a portion of the rectified signal from the rectifier circuit and provides a supply signal to the pulse width modulator circuit. By generating a local DC supply voltage from the existing power supply lines, the adaptor circuit is self powered and thus does not require any external DC supply source such as a battery. Moreover, by coupling the adaptor circuit across the ballast source, there is no need to replace the ballast thus eliminating the need for disposing of the ballast.

In accordance with a further aspect of the present invention, a method for coupling a source signal from a power source to a light source through a magnetic ballast includes the steps of providing the source signal to first and second input terminals of a magnetic ballast, providing, at first and second output terminals, a ballast signal having a first ballast signal frequency and a first ballast signal amplitude and chopping the first ballast signal to provide a light source drive signal having a drive signal frequency which is greater than the first ballast signal frequency. With this particular arrangement, a method of efficiently operating a light source is provided. The chopping step may be implemented by alternately providing low and high impedance signal paths between first and second output terminals of a magnetic ballast. Such operation may be accomplished by relatively biasing a switching element between its conduction and non-conduction states. In one particular embodiment, the chopping step includes the steps of rectifying the ballast signal, generating, from the rectified ballast signal, a control signal having a predetermined frequency and biasing a switching element between a conduction state and a non-conduction state at a frequency corresponding to the control signal frequency. The rectifying step may be accomplished by providing the ballast signal to a first pair of terminals of a rectifier circuit. The switching element may be provided as a switching transistor having a pair of bias terminals coupled to a second pair of terminals of the rectifier and a control terminal to which is provided the control signal. The switching transistor is switched between its conduction and non-conduction states to thus chop the current through the lamp.

In accordance with a still further aspect of the present invention, an adaptor circuit includes a rectifier circuit having a first pair of terminals coupled to first and second terminals of the adaptor circuit and a second pair of terminals, a switching element having first and second switch terminals coupled to the second pair of terminals of the rectifier circuit and a control terminal and a controller having a first terminal coupled to the switching element control terminal, the controller for switching the switching element between a first state and a second state at a switch duty cycle. The adaptor circuit further includes a signal detector coupled to the rectifier circuit for providing a detection signal in response to a drive signal having a predetermined signal level, a feedback signal generator coupled to the signal detector to receive the detection signal and to generate a feedback signal in response thereto, a comparator coupled to the feedback signal generator for comparing a reference signal to the feedback signal and for providing an output signal having a predetermined signal level based on the result of the comparison and means coupled to the controller for reducing the switch duty cycle in response to the capacitor output signal having a first one of first and second signal amplitudes. With this particular arrangement, a ballast adaptor circuit which provides a relatively high frequency drive signal to a lamp and detects the removal of a lamp from a magnetic ballast circuit is provided. By detecting the removal of the lamp from the ballast circuit and reducing a switch duty cycle in response thereto, the controller effectively stops switching the switching element and thus prevents relatively high current signals from propagating through the switch thereby preventing a breakdown of the switch. This results in a relatively reliable adaptor circuit. When the lamp is removed, the detector circuit acts as a peak voltage detector and the feedback signal generator provides a reference voltage to an input port of the comparator which compares the input voltage to a predetermined threshold voltage. In one embodiment, if the threshold voltage is greater than the feedback voltage then the pulse width modulator adjusts the duty cycle of the switching element accordingly to prevent the breakdown of the switching element.

In accordance with a still further aspect of the present invention, a method for detecting removal of a lamp from a lighting unit includes the steps of detecting a drive signal, providing a protection signal in response to the drive signal having a predetermined signal level which at least equals a first threshold signal level, generating a feedback signal having a feedback signal characteristic corresponding to a signal characteristic of the detection signal, comparing the feedback signal to a reference signal, and changing the switch duty cycle in response to the comparison of the feedback signal and the reference signal. With this particular arrangement, a method of detecting lamp removal is provided.

In accordance with a still further aspect of the present invention, an apparatus for providing a magnetic ballast as an instant-start magnetic ballast includes a switching element having a pair of switch terminals coupled to a pair of magnetic ballast output terminals and a control terminal coupled to an output terminal of a controller which provides a switching signal having a predetermined frequency to the switch control terminal. In accordance with this particular arrangement, an instant-start magnetic ballast is provided. When a light source is coupled to the ballast, the switching element is effectively coupled in parallel with the lamp. When the lamp is initially off, the controller biases the switching element into a first state in which the switching element provides a signal path having a relatively low impedance characteristic (e.g. a short circuit impedance characteristic) between the ballast terminals thereby effectively bypassing the lamp. This causes a charging current to flow through the ballast from a power source. The magnetic ballast, having a relatively large storage capacity, stores energy therein. Thus, with the switching element in its first state, the switching element provides a lamp bypass signal path and the ballast stores energy therein. When the switching element is biased into a second state, the switching element provides a signal path having a relatively high impedance characteristic (e.g. an open circuit impedance characteristic) between the ballast terminals. When the switching element is biased into the second state, the lamp presents an impedance to the ballast and the energy stored in the ballast causes an instantaneous voltage to be generated across the magnetic ballast. Also, when the switching element is biased from its first low impedance state to its second high impedance state, the voltage across the ballast reverses polarity and the voltage generated from the energy stored in the ballast combines with the source voltage. When the amplitude of the voltage generated from the energy stored in the ballast is approximately equal to the source voltage amplitude, a strike voltage available to the load is effectively doubled thus providing a lamp strike up voltage which is sufficiently large to allow instant-start up of a fluorescent light source without first warming light source filaments.

It should be noted that the adaptor circuit of the present invention is coupled to ballast terminals and provides a signal path which is in parallel with a lamp or other load with which it will operate. In conventional lighting systems, magnetic ballasts provide a relatively low frequency drive signal to the lamp. The magnetic ballasts, however, present a finite impedance across the lamp. This ballast impedance loading causes distortion of a waveform of the drive signal provided by the ballast to the lamp. This results in the ballast having a relatively low power factor. The adaptor circuit of the present invention, however, cooperates with the ballast to provide a relatively high frequency drive signal to the lamp. The higher frequency operation increases the impedance presented by the ballast to the lamp such that the ballast does not impedance load the lamp. This reduces the effect of the ballast impedance on the waveform shape of the drive signal thereby reducing the amount of drive signal distortion and improving the power factor of the ballast system.

Furthermore, like lamps operate on like drive signals throughout the world. Ballasts, however, must accept electrical power signals from particular ones of different AC power sources which exists in different countries. For example, one ballast may accept 120 volt 60 Hertz power signals and a different ballast may accept 277 volt 60 Hertz power signals. Both ballasts, however may be required to provide an output signal which can drive the same lamp worldwide. The adaptor circuit of the present invention, being coupled across ballast output terminals and lamp input terminals, may be coupled to any ballast and operate with any lamp without any modification regardless of the type of electrical power source used to power the lamp.

BRIEF DESCRIPTION OF THE DRAWINGS

The foregoing features of this invention as well as the invention itself may be more fully understood from the following detailed description of the drawings in which.

DETAILED DESCRIPTION OF THE PREFERRED EMBODIMENT

Figure 1:
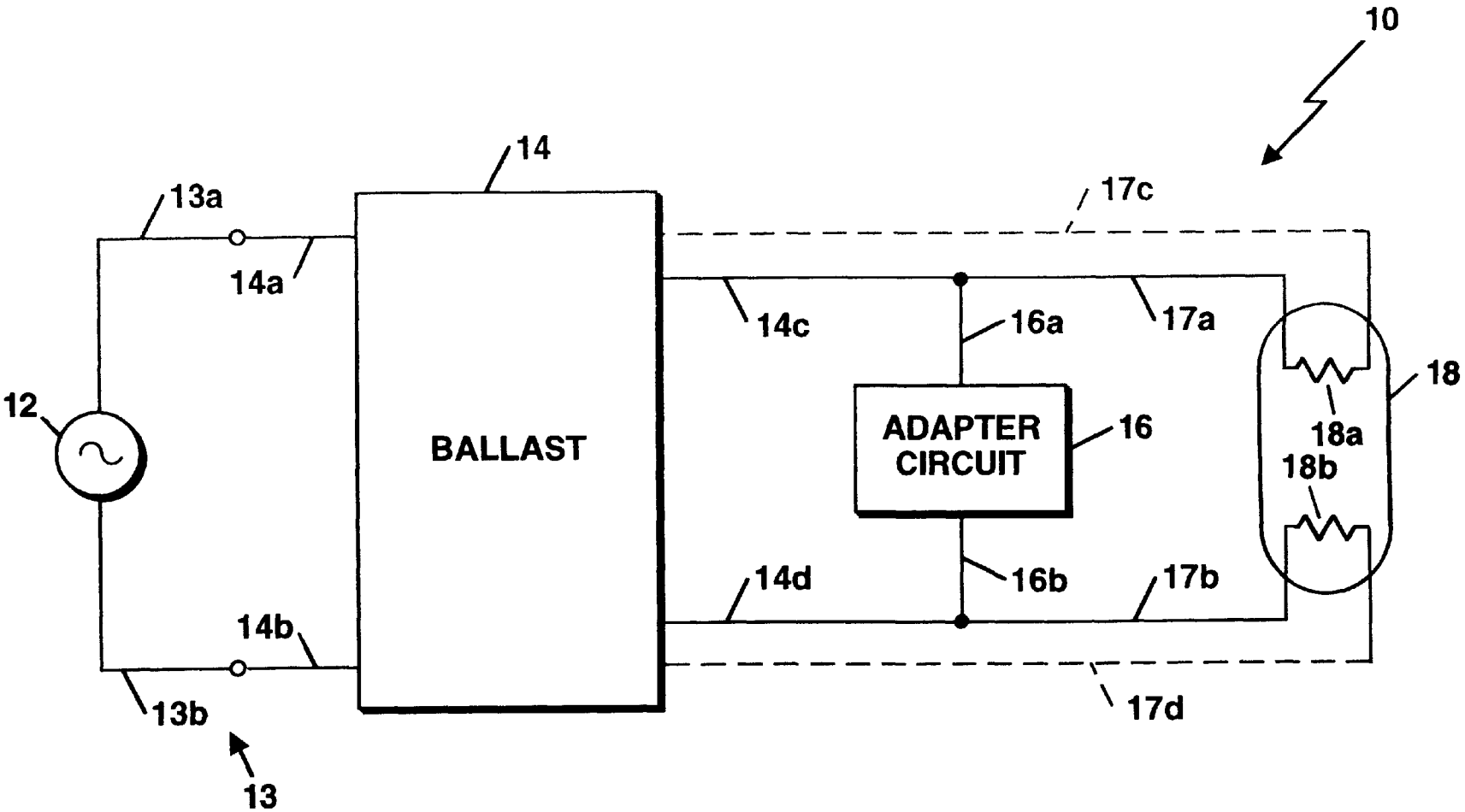
FIG. 1 is a block diagram of a lighting system using the adaptor circuit of the present invention.

Referring now to FIG. 1, an illumination system 10 includes a power source 12 coupled through power supply lines 13*a*, 13*b* generally denoted 13 to a pair of input terminals 14*a*, 14*b* of a ballast 14. Power source 12 provides a power signal through power lines 13 to ballast 14. The power signal may be provided, for example, as a 120 volt (V) 60 Hertz (Hz) alternating current signal. Alternatively, signal source 12 may provide one of a 277 V-60 Hz, 240 V-60 Hz, 240 V-50 Hz or 120 V-50 Hz signals to ballast 14.

Ballast 14 is provided as one of the types which includes a magnetic component. For example, ballast 14 may correspond to a so-called magnetic or inductive or core call ballast. Or, alternatively, ballast 14 may be provided as the type which includes a core-coil choke having an electronic starter. Alternatively still, ballast 14 may be provided as a reactor or lag ballast, a lead ballast or a magnetic regulator ballast. A pair of magnetic ballast output terminals 14*c*, 14*d* are coupled to a light source or lamp 18. Lamp 18 may be provided, for example, as a fluorescent lamp provided from a tube containing mercury vapor, an inert gas (e.g. argon) and having disposed on an inner wall thereof, a phosphor coating which fluoresces or glows when subjected to radiation from a mercury discharge. The color of the light so-produced (usually white or near white) depends upon the phosphors in the phosphor coating. Alternatively, lamp 18 may be provided as a high intensity discharge (HID) lamp which like a fluorescent lamp, requires a ballast for starting and limiting current to the lamp. Lamp 18 may be provided, for example, as a mercury vapor, metal halide, high-pressure sodium or a low-pressure sodium lamp.

Ballast 14 provides a relatively high voltage signal required to start the arc for mercury discharge. Ballast 14 subsequently limits the current provided to the lamp 18 to be of sufficient amplitude to maintain the mercury discharge.

Ballast 14 is coupled to lamp 18 at thermionic cathodes 18*a*, 18*b* with each of the cathodes having a pair of cathode terminals. Thus one of the terminals of thermionic cathode 18*a* is connected with ballast output terminal 14*c* and one of the terminals of thermionic cathode 18*b* is connected with ballast output terminal 14*d*.

Adaptor circuit 16 is coupled in parallel between ballast 14 and lamp 18 as shown and includes a means for chopping the current to lamp 18. At a first predetermined period of time adaptor circuit 16 provides relatively low impedance signal path between ballast terminals 14*c*, 14*d* and at a second predetermined period of time, adaptor circuit 16 provides a relatively high impedance signal path between ballast terminals 14*c*, 14*d*. In one embodiment, the relatively low impedance corresponds to a short circuit impedance and the relatively high impedance corresponds to an open circuit impedance. When the current driven adaptor circuit 16 provides the low impedance signal path between the ballast terminals, the adaptor circuit 16 effectively bypasses the lamp load 18. Adaptor circuit 16 thus drives current through lamp 18 at a so-called chopping frequency.

This results in adaptor circuit 16 driving lamp load 18 with a high frequency current signal which is superimposed on a low frequency current signal provided by ballast 14. Furthermore, the means for chopping the load current provides a continuous flow of sinusoidal low frequency currents through the magnetic ballast 14 and thus improves the power factor and total harmonic distortion performance of magnetic ballast 14.

It should be noted that since adaptor circuit 16 is coupled between ballast terminals 14*c*, 14*d* in parallel with lamp 18, in the event adaptor circuit 16 ceases to operate, magnetic ballast 14 continues to drive lamp 18 and thus no loss of lighting capability is experienced by a user. Thus, when adaptor circuit 16 is operational, a more efficient lighting system is provided. On the other hand, when adaptor circuit 16 is not operational, light system 10 operates as any conventional lighting system which includes a magnetic ballast.

Figure 1A:
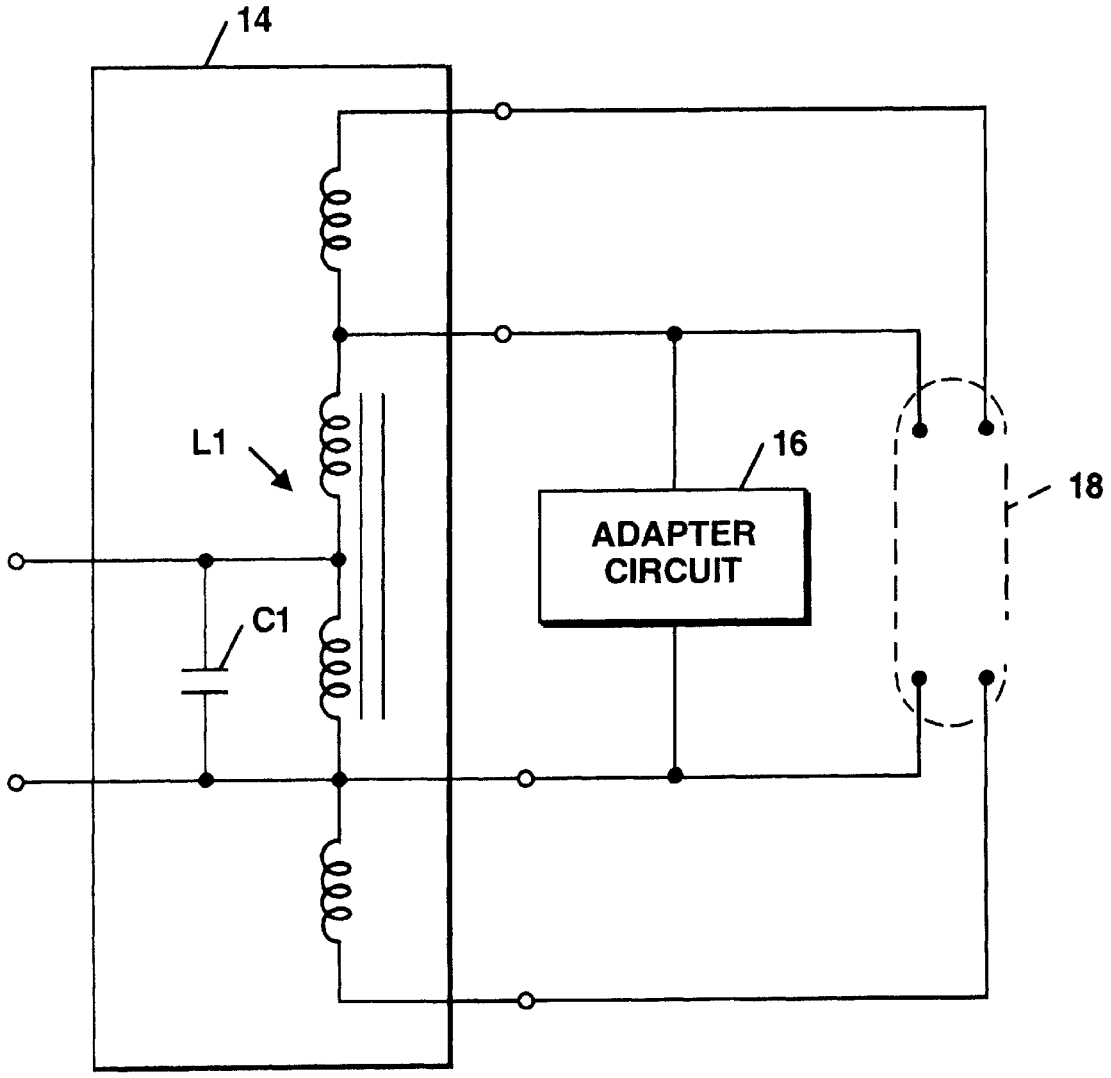
FIG. 1A is a diagrammatic block diagram of a lighting system using the adaptor circuit of the present invention.

The adaptor circuit 16 can also improve the start up characteristics of ballast 14. Referring briefly to FIG. 1A, in which like reference elements of FIG. 1 are provided having like reference designations, ballast 14 is diagrammatically illustrated to include a pair of storage elements C1, L1. Prior to the lamp starting, when the adaptor circuit 16 provides the low impedance signal path between ballast terminals 14*c*, 14*d* the current flowing through the adaptor circuit 16 causes an amount of energy to be stored in the inductive storage elements of magnetic ballast 14. On the other hand, when the adaptor circuit 16 provides a relatively high impedance signal path between ballast terminals 14*c* and 14*d*, the energy stored in the magnetic ballast 14 generates a voltage superimposed on and about equal in amplitude to the output voltage thus doubling the striking voltage capability of the ballasting system. The increase in strike voltage provided by adaptor circuit 16 thus allows the ballast 14 to operate as an instant-start magnetic ballast.

For an instant-start application, one red wire e.g. wire 17*c* and one blue wire e.g. 14 wire 17*d* are disconnected from the magnetic ballast 14. For a rapid start application, on the other hand, wires 17*a*–17*d* are coupled between the lamp 18 and the ballast 14 (i.e. two blue wires and two red wires). In this case, rapid start operation can be achieved by heating the lamp filaments prior to ballast 14 providing a strike voltage.

Figure 2:
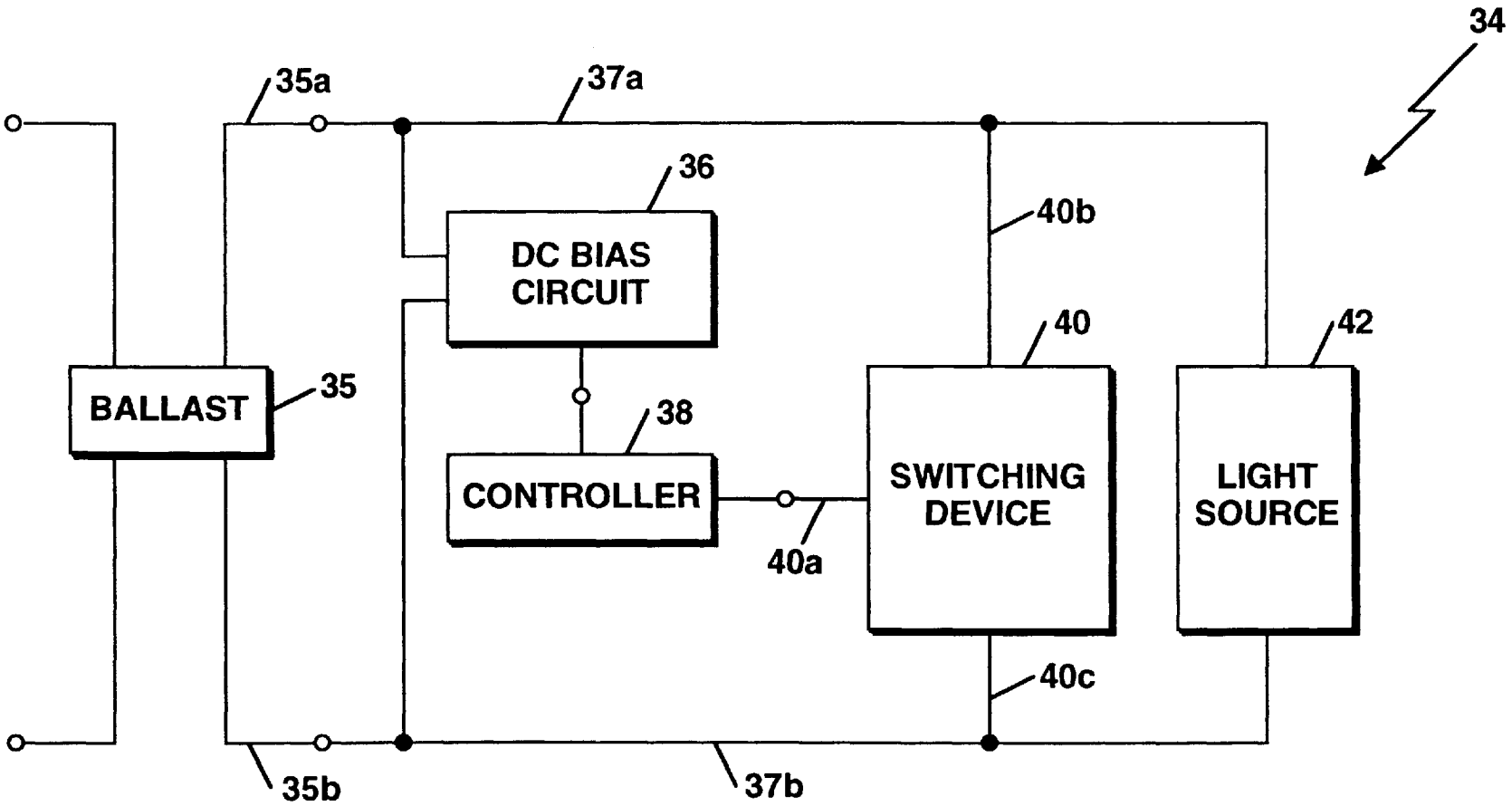
FIG. 2 is a block diagram of an adaptor circuit coupled across a pair of terminals of a lamp.

Referring now to FIG. 2, a lighting unit 34 includes a ballast 35 having a pair of input terminals adapted to be coupled to a power source (not shown) and a pair of output terminals 35*a*, 35*b* coupled through signal paths 37*a*, 37*b* respectively to first and second terminals of a light source 42. A DC bias circuit 36 couples a portion of the signal propagating on signal paths 17*a*, 17*b* between the ballast and the load and generates a DC bias signal which is provided to a power terminal 38*a* of a controller 38. Controller 38 has an output terminal coupled to a control terminal 40*a* of a switching device 40. Switch arms 40*b*, 40*c* are coupled to the ballast signal paths 37*a*, 37*b* and thus switching device 40 is coupled in parallel with light source 42. DC bias circuit 36 receives an alternating current signal propagating between signal paths 37*a*, 37*b* and generates a DC bias signal from the AC signal. This may be accomplished, for example, by including in DC bias circuit 36, a rectifier circuit and filtering circuitry to generate a steady DC bias signal. Controller 38 provides a control signal to control terminal 40*a* of switching device 40. In response to the control signal having a first value, switching device 40 provides a relatively low impedance signal path between signal paths 37*a*, 37*b*. In response to the control signal having a second different value, switching device 40 is placed in a second switch state and provides a relatively high impedance signal path between signal paths 37*a*, 37*b*. Thus, by switching device 40 between its first and second switch states, switching device 40 alternately provides high and low impedance paths between signal paths 37*a*, 37*b*.

Switching device 40 includes a switching element and circuitry which allows the switching element to switch on both positive and negative half cycles of the AC signal propagating between signal paths 37*a*, 37*b*. Such circuitry may include, for example, a rectifier circuit.

Figure 2A:
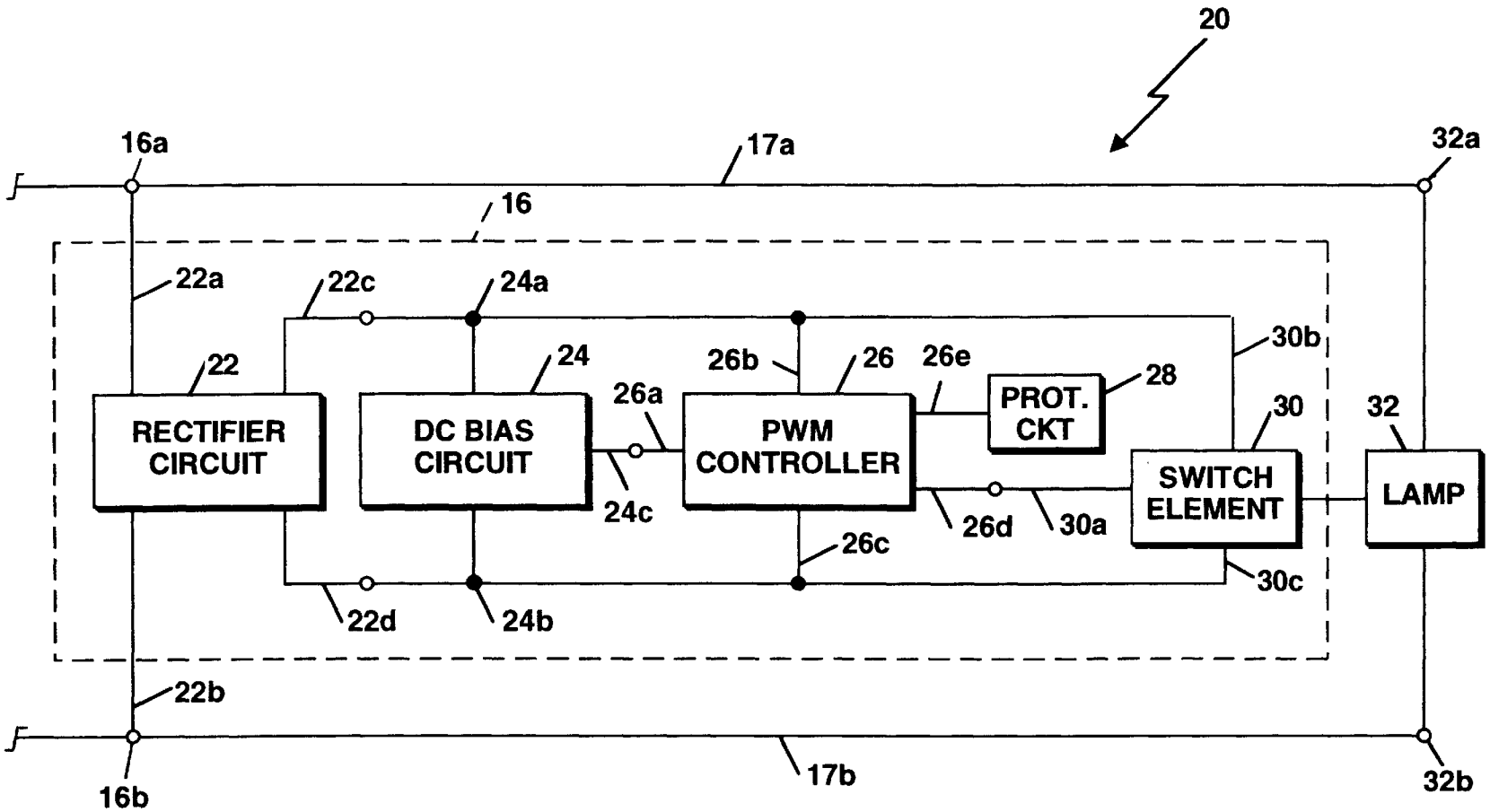
FIG. 2A is block diagram of an adaptor circuit coupled across a pair terminals of a load.

Referring now to FIG. 2A, a portion of a lighting unit 20 includes an adaptor circuit 16 having a pair of terminals 16*a*, 16*b* coupled to respective ones of signal paths 17*a*, 17*b*, generally denoted 17. A first end of signal path 17 is coupled to a ballast (not shown) to a lamp 32. Adaptor circuit 16 includes a rectifier circuit 22 having a first pair of terminals 22*a*, 22*b* coupled to adaptor circuit terminals 16*a*, 16*b* and a second pair of terminals 22*c*, 22*d* coupled to a DC bias circuit 24 at terminals 24*a*, 24*b*. DC bias circuit 24 receives a rectified signal from rectifier circuit 22 and at terminal 24*c* provides a DC bias signal to an input terminal 26*a* of a pulse width modulation controller 26. Pulse width modulation controller 26 is also coupled to terminals 22*c*, 22*d* of rectifier circuit 22. A control terminal 26*d* of controller 26 is coupled to a control terminal 30*a* of a switch 30. Switch inports 30*b*, 30*c* are coupled to terminals 22*c*, 22*d* of rectifier circuit 22.

In operation, an alternating current (AC) signal is provided to rectifier circuit 22 at input ports 22*a*, 22*b* and a rectified signal is provided at output terminals 22*c*, 22*d* of rectifier circuit 22. DC bias circuit 24 couples a portion of the rectified signal and provides a DC bias signal which is used to provide power to controller 26 via input port 26*a*. Controller 26 also couples a portion of the rectified signal and provides a control signal having a predetermined frequency to control terminal 30*a* of switch 30. Switch 30 thus alternates between a conduction state and a non-conduction state at a pulse duty cycle determined by a pulse width modulation controller 26. In response to the control signal fed thereto, switch 30 alternately provides high and low impedance signal paths between rectifier circuit terminals 22*c*, 22*d* which results in a short circuit signal path being provided between terminals 16*a*, 16*b* of adaptor circuit 16. This results in a chopping of the lamp drive signal being fed to lamp 32 at terminals 32*a*, 32*b*.

A protection circuit 28 is coupled to an input port 26*c* of controller 26 and in response to lamp 32 being electrically decoupled from signal paths 17*a*, 17*b*, and thus from the ballast protection circuit 28 causes the pulse width modulation controller 26 to reduce the duty cycle of switch 30 to a relatively low value thereby effectively stopping the switching of switch 30.

Figure 3:
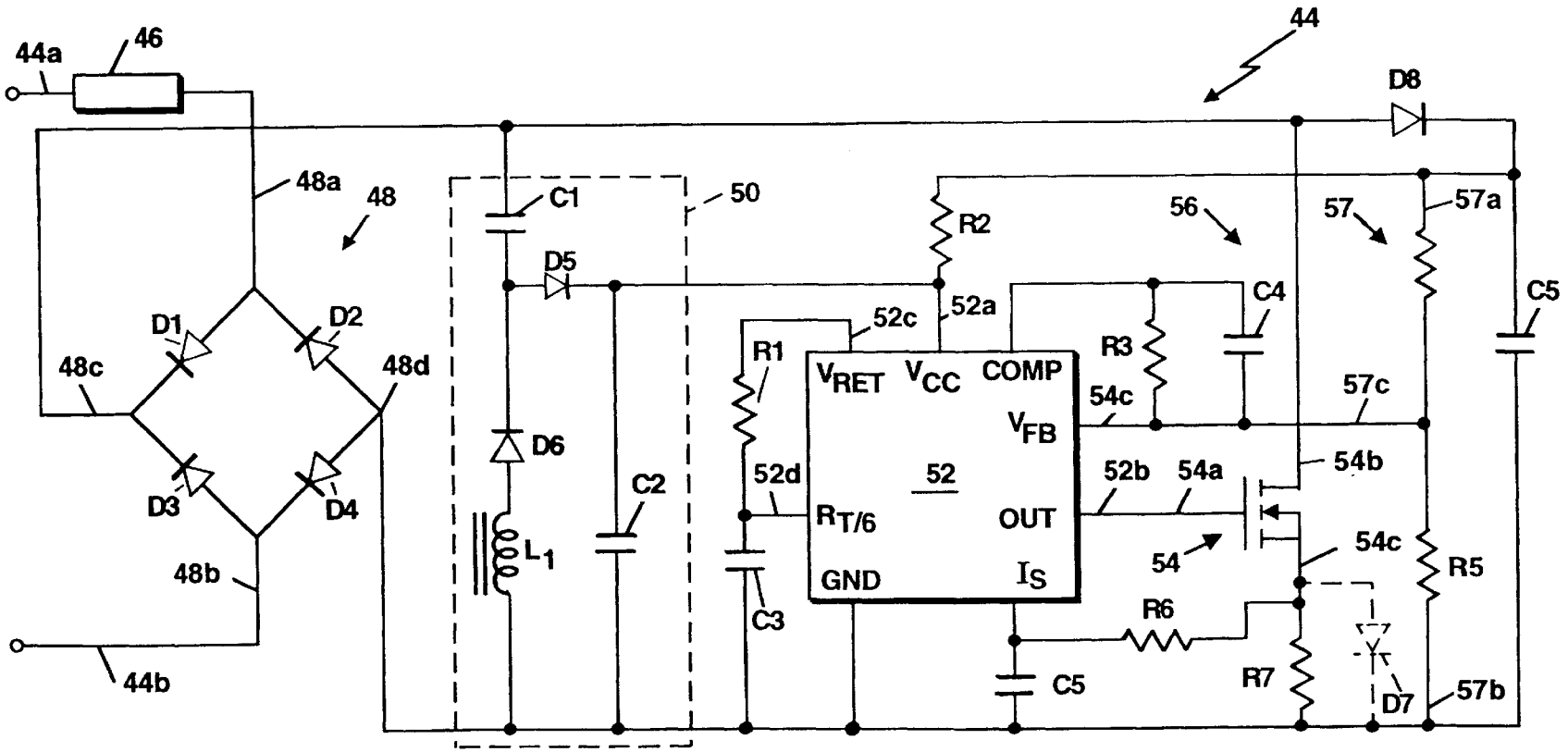
FIG. 3 is a schematic diagram of an adaptor circuit.

Referring now to FIG. 3, an adaptor circuit 44 having terminals 44*a*, 44*b* optionally includes a protection device 46 having a first terminal coupled to terminal 44*a* and a second terminal coupled to a first terminal 48*a* of a rectifier circuit 48. Protection device 46 may be provided on a fuse or a circuit breaker, for example, and is serially coupled between terminal 44*a* and terminal 48*a* of rectifier circuit 48. Thus, in the event of a circuit company failure in adaptor circuit 44, protection device 46 prevents excess current from flowing through adaptor circuit 44.

Rectifier circuit 48 is here provided as a full wave bridge rectifier including diodes D1–D4 coupled as shown. A second terminal 48*b* of rectifier 48 is coupled to adaptor circuit terminal 44*b*. Rectifier circuit terminals 48*c*, 48*d* provide respective ones of positive and negative rails and are coupled to a bias circuit 50 provided from a capacitor C1, a pair of diodes D5, D6, an inductor L1, and a capacitor C2 coupled as shown.

An output port of the bias circuit 50 is coupled to a power terminal 52*a* of a controller circuit 52 which in this particular embodiment is provided as an integrated circuit. Controller 52 may be provided as a high performance current mode controller such as the types manufactured by Motorala Company, Schaumborg, Ill. and identified as part numbers UC2844, UC2845, UC3844 and UC3845. Those of ordinary skill in the art will appreciate that other controllers having similar functional and electrical characteristics may also be used. Those of ordinary skill in the art will also appreciate, of course, that the functions provided by controller 52 may also be provided from discrete circuit components rather than from an integrated circuit.

An output terminal 52*b* of controller 52 is coupled to a switching element 54 which is here shown as a switching transistor 54. In one particular embodiment, transistor 54 is provided as a metal oxide semiconductor (MOS) field effect transistor (FET) having gate source and drain electrodes 56*a*, 56*b* and 56*c*, respectively. Transistor 54 may be provided, for example, as the type manufactured by National Rectifier and identified as part number IRF 730. Those of ordinary skill in the art will recognize, however, that other switching elements having similar switching speeds and power handling capabilities may also be used. Source electrode 54*b* is coupled to terminal 48*c* of rectifier circuit 48 and drain electrode 54*c* is coupled to ground through a bias resistor R7 as shown. A capacitor C5 is coupled between a cathode of diode D8 and ground as shown.

In operation, full wave rectifier 48 generates a pulse voltage between terminals 48*c*, 48*d*. The pulse voltage is provided to DC bias circuit 50 which generates a relatively stable local DC power supply from the AC signal fed to rectifier input ports 48*a*, 48*b*. The local DC supply generated by DC bias circuit 50 is provided to power supply terminal 52*a* of controller 52 to thus power the controller 52. Controller 52 switches the switch 54 at a frequency which is preferably greater than a frequency which can be heard by humans. Thus, switch 54 is preferably switched at a frequency greater than 20 kilo-Hertz (kHz) and even more preferably at a frequency of about 60 kHz to thus avoid generating signals which interfere with infrared (IR) signals.

The chopping frequency is thus selected to avoid producing an audible signal which can be heard by humans. By switching a switch 54 at a signal greater than 20 kHz, it is not necessary to drive a lamp (not shown) with which the adaptor circuit 44 is coupled in parallel with a signal having a relatively pure sinusoidal waveform, since any harmonics generated by an asymmetric waveform shape of the control signal would be above frequencies which are audible to humans. During positive half cycles of the AC power signal provided at the output of the ballast, diodes D2 and D3 are biased into their conduction states. Thus, when switch 54 is biased into its conduction state, a low impedance signal path through diodes D2, D3 and switch 54 exists between terminals 44*a*, 44*b*. Thus during positive half cycles of the AC signal, diodes D2, D3 and switch 54 may provide and form a signal path which is in parallel with a lamp.

Similarly, during negative half cycles of the AC signal, diodes D1, D4 are biased into their conduction states and when switch 54 is biased into its conduction state, a low impedance signal path exists between adaptor circuit terminals 44*a*, 44*b*. Thus, during negative half cycles of the AC signal provided at the output of the ballast, diodes D1, D4 and switch 54 provide a signal path which is in parallel with a lamp. When switch 54 is biased into its conduction state, the parallel signal path is provided having a relatively low impedance characteristic in parallel with a lamp. Conversely, when switch 54 is biased into its non-conduction state, the parallel path is provided having a relatively high impedance characteristic in parallel with the lamp. Thus, by alternately biasing the switch 54 between its conduction and non-conduction states, a lamp or other load may be driven at a relatively high frequency which results in more efficient operation of the lamp or load. It should be noted that in this particular embodiment, since switch 54 is coupled to the ballast output signal paths and thus the lamp through the diodes of bridge rectifier 48, switch 54 performs both a switching function and a control function.

A protection circuit 56 includes a detector diode D8 having an anode coupled to rectifier terminal 48*c* and a cathode coupled to a first terminal 57*a* of a voltage divider circuit 57 provided from resistors R4, R5. A second terminal 57*b* of the voltage divider circuit 57 is coupled to a reference potential here corresponding to ground and a third terminal 57*c* of voltage divider circuit 57 is coupled to a feedback voltage terminal 54*c* of controller 54. A stiffening capacitor 65 is coupled in parallel with voltage divider 57 with a first terminal of capacitor 65 coupled to the cathode of detector diode D8 and a second capacitor terminal coupled to the negative rail, as shown.

The voltage divider 57 produces a feedback voltage at the third terminal thereof. The feedback voltage is coupled to feedback voltage terminal 54*c* of controller 54. When the feedback voltage at terminal 54*c* exceeds a predetermined threshold voltage, the controller 52 reduces the duty cycle at which switch 54 is operating until the duty cycle is such that switch 54 is effectively prevented from switching. Thus, when a lamp is de-coupled from the ballast lines, the feedback voltage rises above the threshold voltage thereby effectively maintaining the switch in a non-conduction state. In one particular embodiment, the threshold voltage is selected to be typically of about 2.5 volts (V).

An optional diode D7 may be coupled between a FET electrode and the negative rail as shown to limit the duty cycle provided by controller 52 to a fixed duty cycle. The frequency and the maximum output duty cycle of the control signal provided at controller output terminal 52*b* are selected by appropriately selecting the resistance value of resistor R1 which is coupled to terminals 52*d*, 52*e* of controller 52. In one particular embodiment, resistor R1 may be provided having a resistance typically of about 10 K ohms which results in a chopping frequency typically of about 20 kHz. Decreasing the resistance value of resistor R1 increases the chopping frequency while increasing the resistance value of resistor R1 decreases the chopping frequency.

A current sense terminal 52*f* is coupled through a resistor R6 to transistor drain electrode 54*c*. Controller 52 thus receives a signal having an amplitude proportional to the amplitude of the current signal through switch 54 and in response to a predetermined current amplitude, controller 52 terminates the transistor switch conduction by biasing transistor 54 into its non-conduction state.

Figure 4:
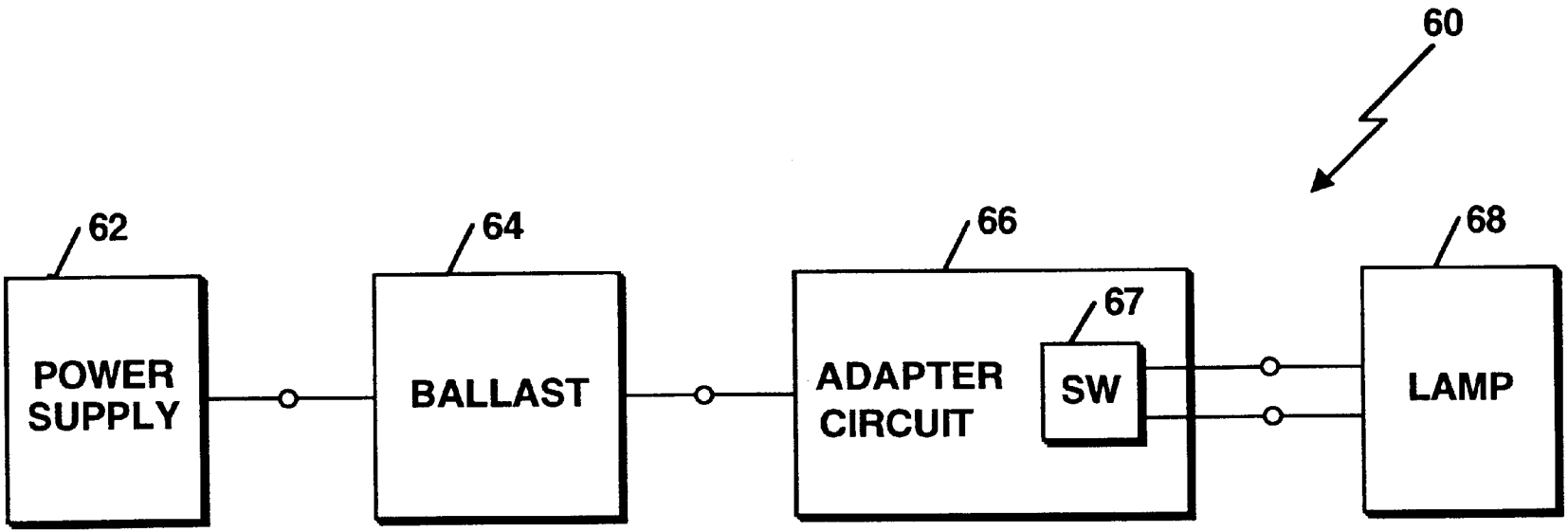
FIG. 4 is a block diagram of a lighting system which includes an adaptor circuit of the present invention.

Referring now to FIG. 4, an illumination system 60 includes a power supply 62 coupled to a lamp 68 through a ballast 64 and an adaptor circuit 66. Adaptor circuit 66 includes a switching device 67 which is coupled to lamp 68. Thus, in this particular embodiment, adaptor circuit 66 is coupled between ballast 64 and lamp 68 and switching device 67 is disposed in a signal path which is parallel coupled to lamp 68.

Ballast 64 receives a power signal from power supply 62 and provides a ballast output signal having a relatively low frequency to an input terminal of adaptor circuit 66. Adaptor circuit 66 receives the signal fed thereto from ballast 64 and operates switching device 67 such that switching device 67 drives lamp 68 with a relatively high frequency drive signal to thus improve the efficiency of illumination system 60.

Figure 5:
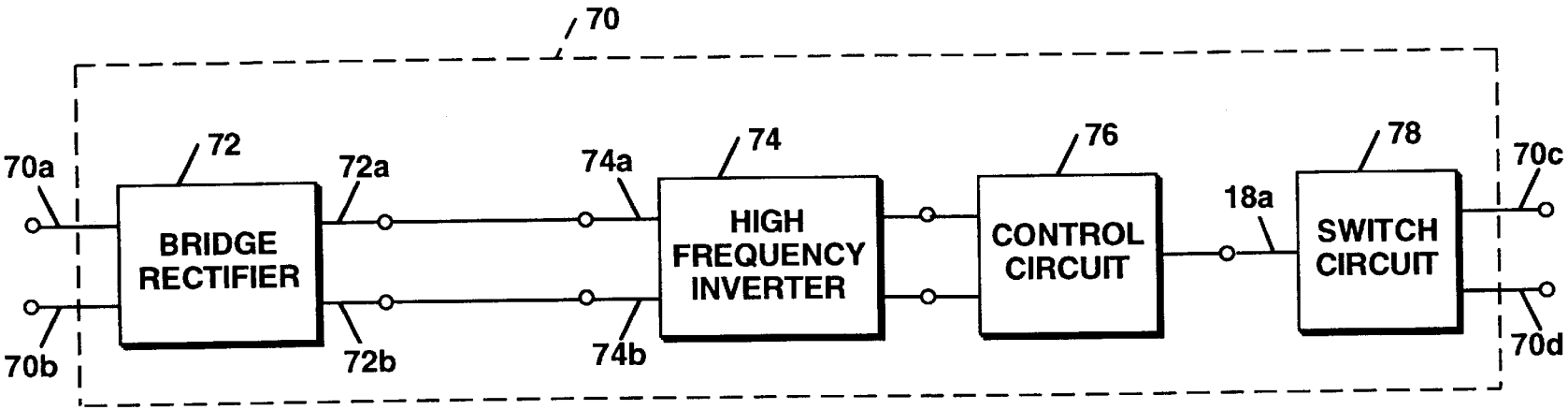
FIG. 5 is a block diagram of an adaptor circuit.

Referring now to FIG. 5, an adaptor circuit 70 includes a rectifier circuit 72 having a pair of terminals corresponding to input terminals 70*a*, 70*b* of adaptor circuit 70. Bridge rectifier 72 may be provided as a full wave rectifier or a half wave rectifier and creates a pulsed DC voltage across terminal 72*a*, 72*b*. Rectifier terminals 72*a*, 72*b* are coupled to a pair of terminals 74*a*, 74*b* of a high frequency inverter circuit 74. Inverter circuit 74 receives the pulsed DC voltage fed thereto and provides an inverter signal having a relatively high frequency to a control circuit 76. Control circuit 76 receives the high frequency inverter signal fed thereto and provides a control signal to a control terminal 78*a* of a switch 78. Switch output arms correspond to output terminals 70*c*, 70*d* of adaptor circuit 70.

In operation, terminals of a magnetic ballast (not shown) are coupled to adaptor circuit terminals 70*a*, 70*b* and terminals of a lamp are coupled to adaptor circuit terminals 70*c*, 70*d*. Thus, switch circuit 78 provides a signal path which is in parallel with a lamp coupled to adaptor circuit terminals 70*c*, 70*d*.

When switch circuit 78 is in its off or unbiased state, the signal path provided by switch circuit 78 has a relatively high impedance characteristic. When switch circuit is in its on or biased state, the signal path provided by switch circuit 78 has a relatively low impedance characteristic. Thus, by repetitively turning the switch on and off at a relatively high frequency via the control circuit 76, the switch drives a lamp coupled to terminals 70*c,* 70*d* with a relatively high frequency signal.

Figure 6:
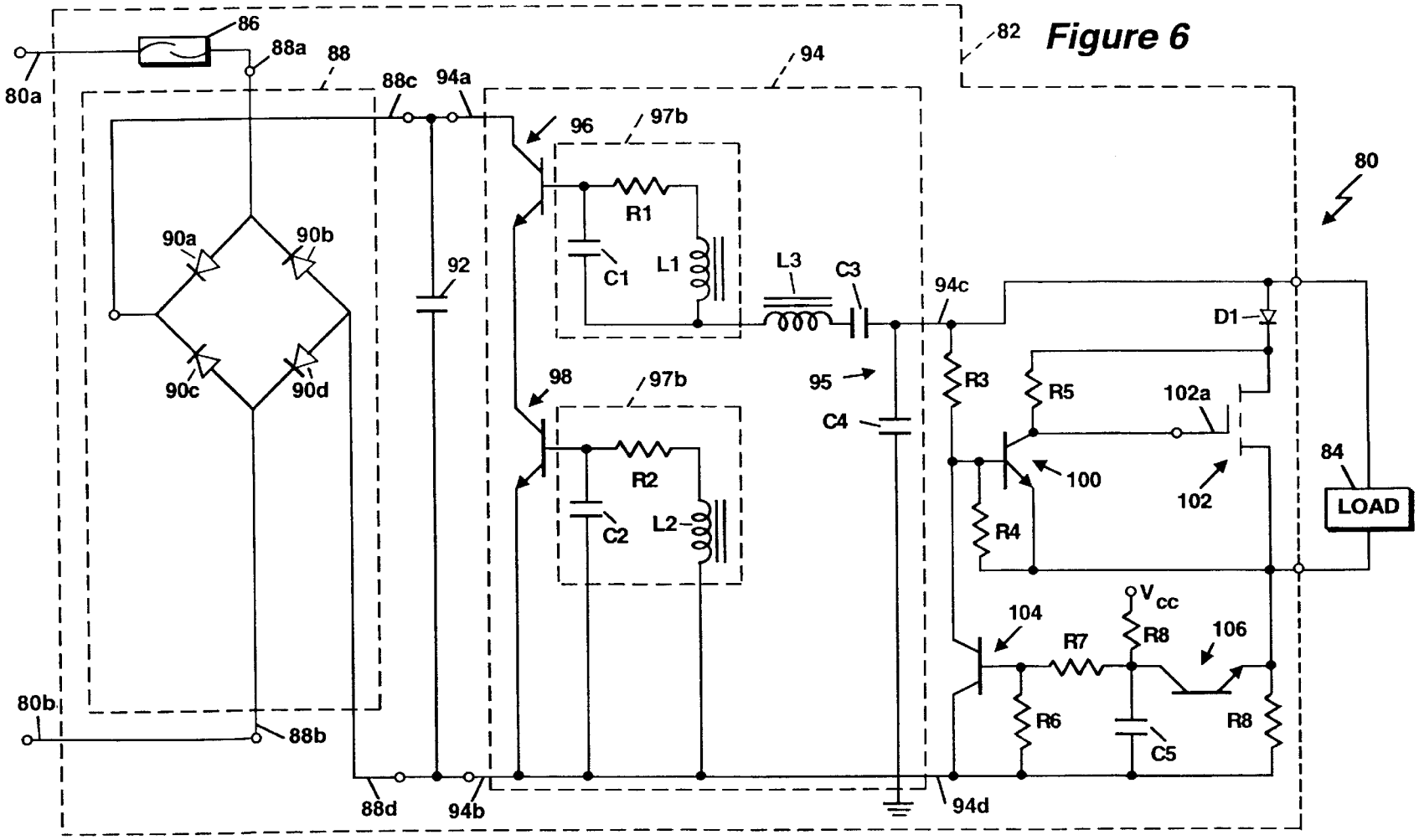
FIG. 6 is a schematic diagram of an adaptor circuit coupled across a pair of input terminals of a load.

Referring now to FIG. 6, a portion of a lighting unit 80 includes an adaptor circuit 82 coupled to a load 84. Terminals 80*a,* 80*b* of adaptor circuit 80 are coupled to output terminals of a ballast (not shown). A protection device 86, which may be provided as a fuse or a circuit breaker, for example, is coupled in series between adaptor circuit terminal 80*a* and a first terminal of a rectifier circuit 88. Thus, if any circuit components of the adaptor circuit 82 fail, protection device 86 prevents excess current from flowing through the adaptor circuit which may present a fire hazard.

Rectifier circuit 88 is here provided as a full wave bridge rectifier including diodes 90*a*–90*d* coupled as shown. A charge storage device 92, here provided as a capacitor 92, is coupled between third and fourth terminals 88*c*, 88*d* of rectifier circuit 88. A high frequency inverter 94 has a first terminal 94*a* coupled to terminal 88*c* of rectifier circuit 88 and a second terminal 94*b* coupled to terminal 88*d* of rectifier circuit 88. In this particular embodiment, high frequency inverter 94 is provided as a half-bridge self resonating type inverter provided from transistor 96, 98, resonating inductors L1, L2 and L3, series capacitors C3 and parallel resonating capacitor C4. Transistors 96, 98 are here provided as bipolar junction transistors (BJT). Each of the transistors 96, 98 has a bias circuit 97*a*, 97*b*, respectively, coupled to a control terminal thereof. As mentioned above, inductors L1, L2, L3 and capacitors C3, C4 form a resonant circuit generally denoted 95 coupled to transistors 96, 98 through transistor bias circuits 97*a*, 97*b*.

The power transistors 96, 98 are driven by the voltage developed across the resonating inductors L1–L3. The switching sequence of the power transistors 96, 98 is achieved by the natural occurrence of current flowing in resonating circuits which include active components. Since the circuit does not include any saturable magnetic elements, it is relatively easy to control. The output of resonant circuit 95 is coupled through a resistor R3 to a base terminal of a bipolar junction transistor 100 and to a collector of a second bi-polar junction transistor 104. Transistors 100, 104 and 106 form a control circuit which controls the switching of a field effect transistor (FET) 102 by application of a control voltage to a gate electrode 102*a* of FET 102. In some embodiments FET 102 may be provided as a power MOS FET. With diode D1 biased into its conduction state, in response to the control voltage having a first voltage level, FET 102 provides a high impedance signal path across load 84. Alternatively with diode D1 biased into its non-conduction state, in response to the control voltage having a second voltage level FET 102 provides a relatively low impedance signal path across load 84. Thus, by switching FET 102 between its conduction and non-conduction states, FET 102 chops the drive signal to the lamp.

The power control feature of adaptor circuit 82 is thus achieved by means of diverting current from the load on a cycle by cycle basis. This is accomplished by turning on the power MOS FET transistor 102 for a portion of the high frequency cycle in response to a control signal provided by the control circuit formed from transistors 100, 104, 106. Once the load current is diverted through transistor 102, the power transferred to the load drops proportionally. Transistor 102 operates in the switching mode, therefore the power dissipated by this transistor is negligible.

The load current waveform in sinusoidal, and thus once the load current crosses zero and becomes positive, transistor 106 is biased into its non-conduction state which initiates a charging sequence during which time a control capacitor C5 is charged from a DC source Vcc which is coupled to capacitor C5 through a resistor R8.

When the base-emitter threshold voltage ($V_{be}$) for transistor 104 is exceeded, transistor 104 turns on which causes transistor 100 to turn off. The resistor R7 controls the timing when transistor 104 will turn on starting from the zero crossing of the lamp current. The turn off of transistor 100 causes transistor 102 to turn on which consequently causes the current from the load 84 to be diverted through transistor 102. The diverted current flows through transistor 102 and resister R8 which will maintain transistor 102 in its on state until the end of the cycle.

Thus, this particular embodiment provides a power inverter which operates at a relatively high frequency (e.g. above 20 kHz) using a single active stage. The circuit also performs power transfer control without controlling the operating frequency of the power switching elements (i.e. the transistors). Furthermore, this particular circuit performs the control in a continuous fashion, preserving at the same time the crest factor for the load current.

Figure 7:
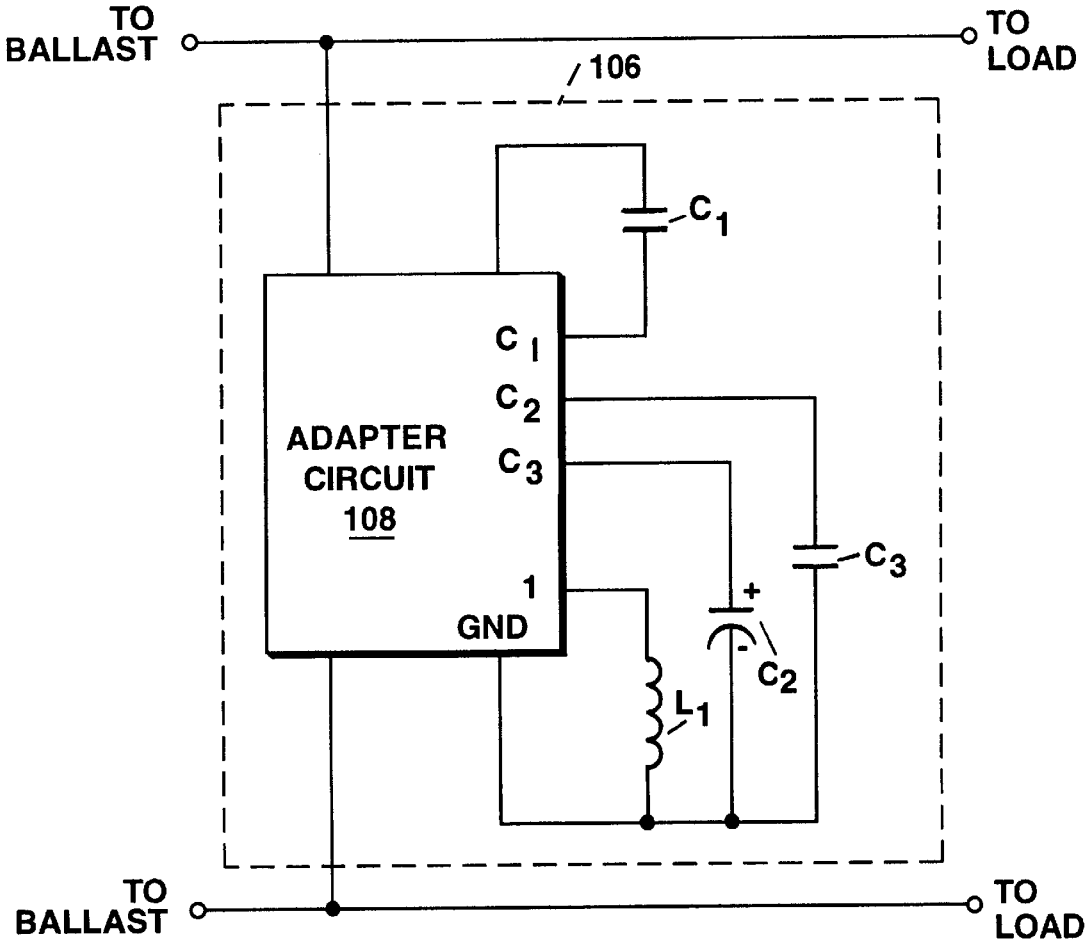
FIG. 7 is a schematic diagram of an adaptor circuit implemented as an integrated circuit.

Referring now to FIG. 7, an adaptor circuit 108 is here shown to be provided as an integrated circuit having a plurality of discrete circuit elements coupled thereto. Integrated circuit 108 is provided having similar or identical functional characteristics as adaptor circuits 16, 35, 44, 66, 70 and 82 discussed above in conjunction with FIGS. 1–6 respectively. By providing an adaptor circuit as an integrated circuit, however, the adaptor circuit provides the adaptor circuit as a relatively reliable, relatively inexpensive circuit.

Figure 8:
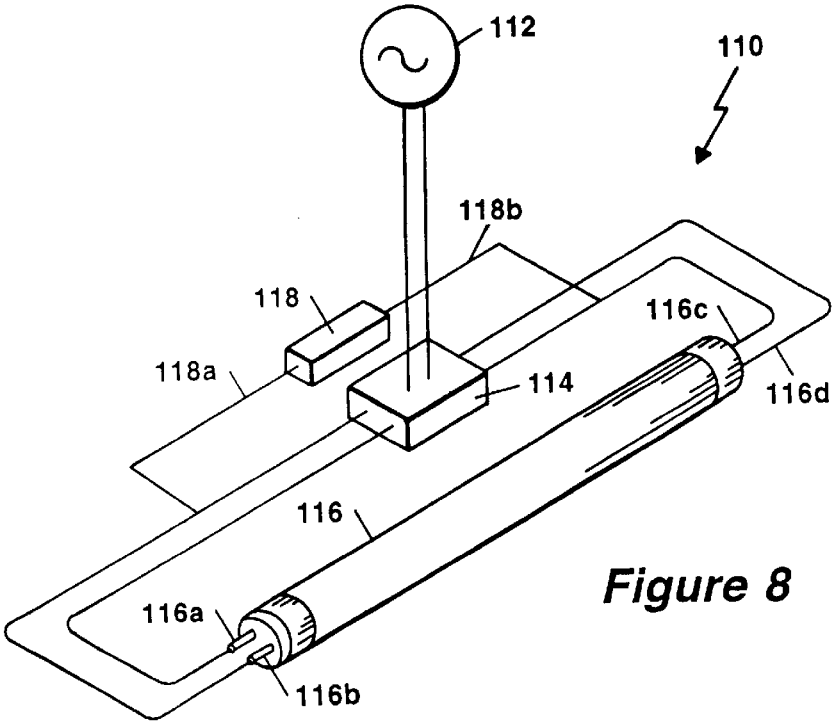
FIG. 8 is a diagram of a fluorescent lamp interconnected to a ballast and an adaptor circuit.

Referring now to FIG. 8, a lighting system 110 includes a source 112 coupled to a conventional magnetic ballast 114. Magnetic ballast 114 is coupled to a conventional lamp 116 at terminals 116*a*–116*d,* as shown. Lamp 116 may be provided, for example, as a fluorescent or an HID lamp. An adaptor circuit 118 is coupled across first and second signal paths of magnetic ballast 114 to thus drive current through lamp 116 at a predetermined chopping frequency. Terminal 118*a* of adaptor circuit 118 may be coupled, for example, to a so-called red wire of ballast 114 while adaptor circuit terminal 118*b* is coupled to a so-called blue wire of ballast 114.

Figure 9:
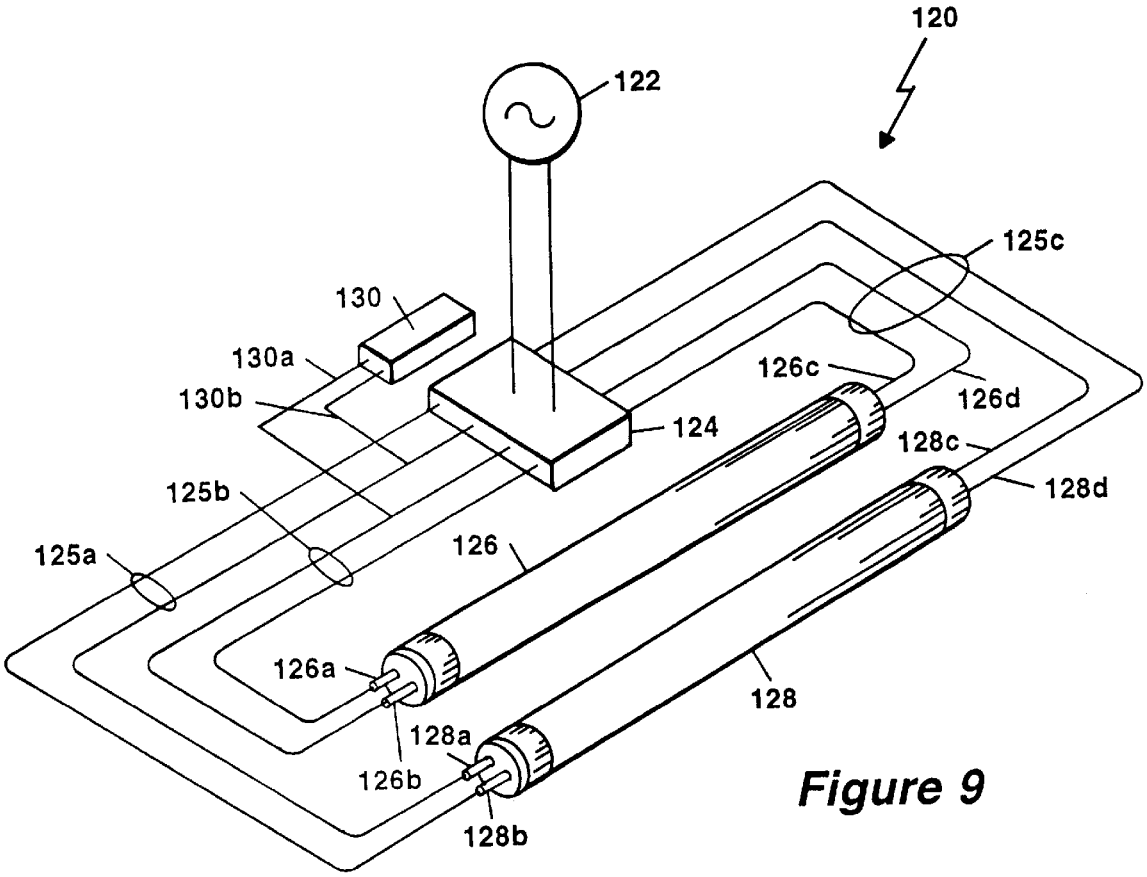
FIG. 9 is a diagram of a pair of fluorescent coupled to a magnetic ballast and an adaptor circuit.

Referring now to FIG. 9, a lighting system 120 includes a source 122 which provides an AC signal to a magnetic ballast circuit 124. Magnetic ballast circuit 124 is coupled to a pair of fluorescent lamps 126–128 in a manner which is generally known. An adaptor circuit 130 has a pair of terminals 130*a,* 130*b* coupled to first and second terminals 124*a*, 124*b* of ballast circuit 124.

In this particular example, ballast wire pair 125*a* may correspond to a pair of so-called red wires while wire pair 125*b* corresponds to so-called blue wires. Thus, adaptor circuit terminals 130*a,* 130*b* are coupled to one red wire and one blue wire respectively. Wires leading from lamp terminals 126*c,* 126*d,* 128*c,* 128*d* to ballast 124 correspond to so-called yellow wires. Adaptor circuit 130 is thus coupled to drive current through the fluorescent lamps 126, 128 at a predetermined chopping frequency.

It should be noted that ballast 124 and lamps 126 and 128 may correspond to conventional ballast circuits and lamps. Thus, there is no need to disconnect the ballast circuit from the lamp in order to connect adaptor circuit 130. Furthermore, adaptor circuit 130 generates a local DC supply from the existing power lines and thus is self powered. The adaptor circuit 130 controls the lamp operation frequency on a cycle basis. If the adaptor circuit 130 stops operating, lamps 126, 128 are still driven by the low frequency signal provided from conventional ballast 124. However, with adaptor circuit 130 in operation, the lamp operates in a more efficient manner.

Having described preferred embodiments of the invention, it will now become apparent to one of skill in the art that other embodiments incorporating the concepts may be used. It is felt, therefore, that these embodiments should not be limited to disclosed embodiments but rather should be limited only by the spirit and scope of the appended claims.

I claim:

1. An apparatus for coupling a source signal from a power source to a lamp, the source signal having a first source signal frequency and a first source signal amplitude and the apparatus comprising:

a ballast having first and second ballast input terminals coupled to first and second power terminals of the power source and first and second ballast output terminals coupled to first and second terminals of the lamp, said ballast for receiving the source signal and for providing at the first and second ballast output terminals, a ballast signal having a first ballast signal frequency and a first ballast signal amplitude; and an adapter circuit having a first terminal coupled to the first output terminal of said ballast and a second terminal coupled to the second output terminal of said ballast, the adapter circuit for receiving the ballast signal having the first ballast signal frequency and the first ballast signal amplitude and for providing a drive signal to the lamp, the drive signal having a first drive signal frequency and a first drive signal amplitude, wherein the first drive signal is responsive to a feedback signal which corresponds to the ballast signal, wherein said adapter circuit includes a switching device having a first terminal coupled to the first terminal of said adapter circuit and a second terminal coupled to the second terminal of said adapter circuit thereby providing a signal path between the first and second terminals of said adapter circuit, said switching device having a first impedance characteristic in response to a first control signal having a first signal level and a second different impedance characteristic in response to the control signal having a second different signal level.

2. The apparatus of claim 1 wherein said switching device comprises:

a rectifier circuit having a first terminal coupled to the first terminal of said adapter circuit, a second terminal coupled to the second terminal of said adapter circuit, a third terminal and a fourth terminal; and a switch having a first terminal coupled to the third terminal of said rectifier circuit, a second terminal coupled to the fourth terminal of said rectifier circuit and a control terminal.

3. The apparatus of claim 2 further comprising:

a DC bias circuit having a first terminal coupled to the third terminal of said rectifier circuit, a second terminal coupled to the fourth terminal of said rectifier circuit and an output terminal; and a controller having a first terminal coupled to the third terminal of said DC bias circuit, second and third terminals coupled to respective ones of the third and fourth terminals of said rectifier circuit and a fourth terminal coupled to the control terminal of said switch.

4. The apparatus of claim 3 wherein:

said rectifier is provided as a full wave bridge rectifier;

said controller is provided as pulse width modulation controller; and said switch is provided as a transistor.

5. The apparatus of claim 4 wherein said transistor is provided as a field effect transistor.

6. The apparatus of claim 5 further comprising a protection element having a first terminal coupled to a first terminal of said adapter circuit and a second terminal coupled to a first terminal of said full wave bridge rectifier.

7. The apparatus of claim 6 wherein said DC bias circuit comprises:

a first storage device having a first terminal coupled to the third terminal of said bridge rectifier and a second terminal;

a first diode having a first terminal coupled to the second terminal of said storage device and a second terminal corresponding to the output terminal of said DC bias circuit;

a second diode having a first terminal coupled to the first terminal of said first diode and a second terminal;

a second storage device having a first terminal coupled to the second terminal of said second diode and a second terminal coupled to the fourth terminal of said rectifier circuit; and a third storage device having a first terminal coupled to the second terminal of said first diode and a second terminal coupled to the fourth terminal of said rectifier circuit.

8. The apparatus of claim 7 wherein:

said first storage device is provided as a first capacitor;

said second storage device is provided as an inductor; and said third storage device is provided as a second capacitor.

9. The apparatus of claim 8 wherein:

the first terminal of said first diode corresponds to an anode and the second terminal of said first diode corresponds to a cathode; and the first terminal of said second diode corresponds to a cathode and the second terminal of said second diode corresponds to an anode.

10. The apparatus of claim 1, wherein the feedback signal decreases the first drive signal frequency when the lamp is de-coupled from the apparatus.

11. A magnetic ballast adapter circuit having a first terminal and a second terminal, the magnetic ballast adapter circuit for providing an excitation signal from a magnetic ballast source to a load, the magnetic ballast adapter circuit comprising:

a rectifier circuit having a first terminal coupled to the first terminal of the magnetic ballast adapter circuit, a second terminal coupled to the second terminal of the magnetic ballast adapter circuit, a third terminal and a fourth terminal;

a DC bias circuit coupled to the rectifier circuit;

a control circuit having a first terminal coupled to the third terminal of said rectifier circuit, a second terminal coupled to the fourth terminal of said rectifier circuit and an output terminal; and a switching device having a first terminal coupled to the third terminal of said rectifier circuit, a second terminal coupled to the fourth terminal of said rectifier circuit and a control terminal coupled to the output terminal of said control circuit.

12. The adapter circuit of claim 11 wherein:

said rectifier circuit is provided as a full wave bridge rectifier;

said controller is provided as pulse width modulation controller; and said switching device includes a transistor having a first, second and control electrodes corresponding to respective ones of the first, second and control terminals of said switching device.

13. The adapter circuit of claim 12 wherein said transistor is provided as a field effect transistor.

14. The adapter circuit of claim 13 further comprising a protection element having a first terminal coupled to a first terminal of the magnetic ballast adapter circuit and a second terminal coupled to a first terminal of said rectifier circuit.

15. The adapter circuit of claim 14, wherein the DC bias circuit has first and second terminals coupled to respective ones of the third and fourth terminals of said terminal circuit, and a third terminal coupled to a power supply terminal of said pulse width modulator circuit.

16. The adapter circuit of claim 15 wherein said DC bias circuit comprises:

a first storage device having a first terminal coupled to the third terminal of said bridge rectifier and a second terminal;

a first diode having a first terminal coupled to the second terminal of said storage device and a second terminal corresponding to the output terminal of said DC bias circuit;

a second diode having a first terminal coupled to the first terminal of said first diode and a second terminal;

a second storage device having a first terminal coupled to the second terminal of said second diode and a second terminal coupled to the fourth terminal of said rectifier circuit; and a third storage device having a first terminal coupled to the second terminal of said first diode and a second terminal coupled to the fourth terminal of said rectifier circuit.

17. The adapter circuit of claim 16 wherein:

said first storage device is provided as a first capacitor;

said second storage device is provided as an inductor; and said third storage device is provided as a second capacitor.

18. The adapter circuit of claim 17 wherein:

the first terminal of said first diode corresponds to an anode and the second terminal of said first diode corresponds to a cathode; and the first terminal of said second diode corresponds to a cathode and the second terminal of said second diode corresponds to an anode.

19. A method for coupling a source signal from a power source to a lamp through a ballast, the source signal having a first source signal frequency and a first source signal amplitude and the method comprising the steps of:

providing the source signal to first and second input terminals of the ballast;

providing, at first and second ballast output terminals, a ballast signal having a first ballast signal frequency and a first ballast signal amplitude;

detecting whether the lamp is coupled to the ballast; and chopping the first ballast signal to provide a lamp drive signal having a drive signal frequency wherein the drive signal frequency is greater than the first ballast signal frequency, wherein said chopping step includes the step of (a) providing a low impedance signal path between the first and second output terminals of the ballast for a first predetermined period of time; and (b) providing a high impedance signal path between the first and second output terminals of the ballast for a second predetermined period of time, (c) providing the ballast signal to a rectifier circuit;

(d) rectifying the ballast signal;

(e) coupling the rectified ballast signal from the rectifier circuit to a control signal generator;

(f) generating a control signal from the rectified ballast signal, the control signal having a first control signal frequency; and (g) alternately biasing a switching device between a first state and a second state at the control signal frequency, wherein the switching device is disposed in a signal path between the first and second output terminals of the magnetic ballast and wherein the switching device provides a low impedance signal path in the first state and a high impedance signal path in the second state.

20. A method for coupling a source signal from a power source to a lamp through a ballast, the source signal having a first source signal frequency and a first source signal amplitude and the method comprising the steps of:

providing the source signal to first and second input terminals of the ballast;

providing, at first and second ballast output terminals, a ballast signal having a first ballast signal frequency and a first ballast signal amplitude;

detecting whether the lamp is coupled to the ballast; and chopping the first ballast signal to provide a lamp drive signal having a drive signal frequency wherein the drive signal frequency is greater than the first ballast signal frequency, wherein said chopping step includes the step of (a) providing a low impedance signal path between the first and second output terminals of the ballast for a first predetermined period of time; and (b) providing a high impedance signal path between the first and second output terminals of the ballast for a second predetermined period of time, wherein a switching device has a first terminal, a second terminal and a control terminal and a rectifier circuit has a first pair of terminals coupled to respective ones of the first and second ballast output terminals and a second pair of terminals coupled to respective ones of the first and second terminals of the switching device.

21. An adapter circuit having first and second terminals, the adapter circuit comprising:

a full wave bridge rectifier circuit having first and second terminals coupled to the first and second terminals of the adapter circuit and having third and fourth terminals;

a switch having a control terminal, a first switch terminal coupled to the third terminal of said rectifier circuit and a second switch terminal coupled to the fourth terminal of said rectifier circuit, the switch being a field effect transistor;

a pulse width modulation controller, having a first terminal coupled to the control terminal of said switch, said controller for switching said switch between a first state and a second state at a switch duty cycle;

a signal detector coupled to said rectifier circuit, said signal detector to provide a detection signal in response to a drive signal having a predetermined signal level wherein the predetermined signal level at least equals a first threshold signal level;

a feedback signal generator, coupled to said signal detector to receive the detection signal from said signal detector and to generate a feedback signal in response thereto;

a comparator, coupled to said feedback signal generator, for comparing a reference signal to the feedback signal wherein said comparator provides an output signal having a first signal level in response to an amplitude of the reference signal being greater than an amplitude of the feedback signal and having a second different signal level in response to an amplitude of the reference signal being less than an amplitude of the feedback signal; and means, coupled to said controller, for reducing the switch duty cycle in response to the comparator output signal having a first one of the first and second signal amplitudes, a DC bias circuit coupled between said rectifier circuit and said pulse width modulator circuit including a first storage device having a first terminal coupled to the third terminal of said bridge rectifier and a second terminal;

a first diode having a first terminal coupled to the second terminal of said storage device and a second terminal corresponding to the output terminal of said DC bias circuit;

a second diode having a first terminal coupled to the first terminal of said first diode and a second terminal;

a second storage device having a first terminal coupled to the second terminal of said second diode and a second terminal coupled to the fourth terminal of said rectifier circuit; and a third storage device having a first terminal coupled to the second terminal of said first diode and a second terminal coupled to the fourth terminal of said rectifier circuit.

22. The circuit of claim 21 wherein:

said first storage device is provided as a first capacitor;

said second storage device is provided as an inductor; and said third storage device is provided as a second capacitor.

23. The circuit of claim 22 wherein:

the first terminal of said first diode corresponds to an anode and the second terminal of said first diode corresponds to a cathode; and the first terminal of said second diode corresponds to a cathode and the second terminal of said second diode corresponds to an anode.

* * * * *